US005675913A

United States Patent [19]

Matsuda et al.

[11] Patent Number: 5,675,913

[45] Date of Patent: Oct. 14, 1997

[54] PHOTOSENSITIVE MATERIAL PROCESSING APPARATUS

[75] Inventors: Shinichi Matsuda; Ryouei Nozawa; Jun Ikeda; Kenro Yamamoto; Mitsuru Katsumata, all of Kanagawa, Japan

[73] Assignee: Fuji Photo Film Co., Ltd., Kanagawa, Japan

[21] Appl. No.: 220,669

[22] Filed: Mar. 31, 1994

[30] Foreign Application Priority Data

Mar. 31, 1993 [JP] Japan ..... 5-073670
Mar. 31, 1993 [JP] Japan ..... 5-073673

[51] Int. Cl.[6] ..... F26B 13/10

[52] U.S. Cl. ..... 34/526; 34/549; 34/535; 34/546

[58] Field of Search ..... 34/443, 444, 445, 34/446, 454, 549, 526, 535, 546, 536

[56] References Cited

U.S. PATENT DOCUMENTS

| | | | |
|---|---|---|---|
| 3,834,040 | 9/1974 | Russell et al. | 34/655 |
| 4,231,164 | 11/1980 | Barbee | 34/452 |
| 4,978,560 | 12/1990 | Stone | 427/366 |
| 5,323,546 | 6/1994 | Glover et al. | 34/446 |
| 5,452,524 | 9/1995 | Isozaki et al. | 34/454 |

FOREIGN PATENT DOCUMENTS

| | | |
|---|---|---|
| 2149844 | 6/1990 | Japan . |
| 3131852 | 6/1991 | Japan . |
| 3132659 | 6/1991 | Japan . |
| 572708 | 3/1993 | Japan . |
| 2069717 | 8/1981 | United Kingdom . |

*Primary Examiner*—John M. Sollecito
*Assistant Examiner*—Steve Gravini
*Attorney, Agent, or Firm*—Sughrue, Mion, Zinn, Macpeak & Seas

[57] ABSTRACT

A photosensitive material processing apparatus is equipped with a drying section in which a photosensitive material processed with a processing solution is conveyed by a plurality of rollers and dried by drying air from a drying air blowing device. In the photosensitive material processing apparatus, a plurality of heating rollers is disposed to form a part of the above-described plurality of rollers and whose surfaces are heated by a heat source. A control means effects on-off control for the heat source during processing of the photosensitive material to set the surface temperature of each of the plurality of heating rollers and to control the drying air blowing device to lower the surface temperature of each of the plurality of heating rollers by the drying air during a standby period. Accordingly, during the standby period, the surface temperature of each of the plurality of heating rollers is lowered forcibly by the drying air, so that overshooting is restricted.

21 Claims, 6 Drawing Sheets

PHOTOSENSITIVE MATERIAL PROCESSING APPARATUS

BACKGROUND OF THE INVENTION

1. FIELD OF THE INVENTION

The present invention relates to a photosensitive material processing apparatus which is equipped with a drying section in which a photosensitive material delivered to the drying section in which a photosensitive material delivered to the drying section after being processed with processing solutions is conveyed by a plurality of rollers and is dried by drying air from a drying air blowing device.

2. DESCRIPTION OF THE RELATED ART

A photosensitive material on which an image is exposed is sequentially developed, fixed and washed with processing solutions including a developing solution, fixing solution and washing water, respectively, and then conveyed to a drying section to be dried therein.

In the drying section, a plurality of rollers are arranged in a zigzag manner or are disposed in an opposing relationship to each other. The photosensitive material processed with the processing solutions passes between these rollers. Obverse and reverse surfaces of the photosensitive material contact these rollers alternately, so that the photosensitive material is conveyed by a conveying force applied thereto.

Here, an opening for blowing out drying air is respectively disposed between these rollers. Accordingly, the photosensitive material is adapted to be dried by drying air blown onto the photosensitive material while passing through between these rollers.

On the other hand, for the purpose of obtaining an improvement in processing efficiency, there has been a recently demand for increasing the conveying speed of the photosensitive material without extending the length of the dry path. In order to comply with this demand, a portion of the above-described plurality of rollers, located at an upstream side, serve as heating rollers to heat the photosensitive material efficiently, and thereby promote the evaporation of water contained in the photosensitive material.

As a result, the photosensitive material that exceed a saturated water content after being processing first contacts the heating rollers to promote evaporation of water from the photosensitive material. After that, since an ambient atmosphere in a high-humidity state is removed from the surface of the photosensitive material by drying air, the drying efficiency is improved, thereby making it possible to improve the processing efficiency without extending the length of the dry path.

Heating rollers of even number (for example, four) are usually provided. Each heating roller is provided with a temperature sensor which is disposed at a center portion on the surface of the roller in an axial direction thereof in order to contact the roller. The temperature sensor controls the heating temperature of the heating roller by an on-off control of a heat source contained in the heating roller.

However, when the surface temperature of the heating rollers are maintained at a predetermined temperature during a standby period, the temperature of other members within the drying section, such as the non-heating rollers in the vicinity of the heating rollers, and the temperature of members in the vicinity of the drying section, such as the squeezing rollers, become excessively high. As a result, the photosensitive material is somewhat overdried in an early stage of drying time period so that the image quality thereof may deteriorate. Further, an unnecessary amount of electric power is consumed during the standby period, thereby causing the running cost to increase.

In order to solve the aforementioned problems, the surface temperature of each heating roller is set to be slightly lower than a predetermined temperature during the standby period, and when the photosensitive material comes to a predetermined position, the surface temperature thereof is raised to the predetermined temperature. However, when the conveying speed of the photosensitive material varies, it is not possible to raise the temperature at a suitable time, thereby causing an undried portion or an overdried portion of the photosensitive material. Namely, if a start time for raising the surface temperature is set in accordance with a high conveying speed, when the conveying speed is low, there are possibilities that each temperature of the members in the vicinities of the heating rollers may become higher excessively, and that the photosensitive material may be conveyed to the drying section in a state in which the surface temperature of each heating roller overshoots before it is stabilized. As a result, it is considered that the photosensitive material may be overdried. Further, if the start time of raising of the temperature is set in accordance with a case when the conveying speed is low, or when the conveying speed is high, an undried portion may be formed in the photosensitive material in an early stage of the drying time period.

Further, during the standby period, particularly when a drying fan does not operate, if the temperature of each heating roller is controlled only by an on-off control of the heat source, hunting (i.e., width of vibration with a threshold value as a boundary) becomes large, particularly for large overshooting. Accordingly, it is necessary to take account of heat resistance and durability of the members in the vicinities of the heating rollers to improve safety.

Further, the surface temperature of each heating roller is set independently of the temperature of the drying air used together with the heating rollers, and the set temperature of each heating roller is simply varied in accordance with the length of a processing time of the photosensitive material.

However, in order to dry the photosensitive material uniformly, there is a need for a correlation between the drying by means of the heating rollers and the drying by means of the drying air. Accordingly, when the correlation between theme is unbalanced, for example, when the rate which the heating rollers contribute to the drying of the photosensitive material is larger than that which they drying by means of drying air may cause the photosensitive material to be overdried. Thus, when the drying by means of the heating rollers and they drying by means of the drying air become non-uniform for some reason, drying marks may occur, which is not preferable.

Further, when the amount of the photosensitive material to be processed increases in the drying section, drying efficiency may deteriorate due to an increase in humidity within the drying section, or the like. Therefore, this deterioration of drying efficiency is compensated with an increase in the temperature of the drying air. However, it was necessary to previously increase the heating capacity for the increase in temperature of the drying air, and at the same time, there was a possibility that drying by means of the drying air and the heating rollers might become unbalanced. Moreover, the drying efficiency is largely influenced by environmental conditions (i.e., temperature and humidity) of a location where an apparatus is installed.

Further, water evaporated by the heating rollers may become a boundary film on the surface of the photosensitive material to form a water vapour layer thereby resulting the photosensitive material not being efficiently dried.

In view of the aforementioned, it is an object of the present invention to provide a photosensitive material processing apparatus which, when the temperature of a heating roller is controlled, restricts the overshooting thereof, and which can set the temperature to be slightly lower than a predetermined temperature to reduce consumed electric power during a standby period, and can raise the temperature to the predetermined temperature at a suitable time after processing of the photosensitive material is started. It is another object of the present invention to provide a photosensitive material processing apparatus which takes account of the correlation between drying by means of a heating roller and drying by means of drying air to set the temperature of each heating roller and the drying air, which can vary the respective set temperatures in accordance with such various factors that influence drying efficiency, such as the amount of film to be processed, the environmental conditions, etc., to perform dry processing of the photosensitive material in a suitable manner without the formation of any drying mark.

SUMMARY OF THE INVENTION

In accordance with a first aspect of the present invention, there is provided a photosensitive material processing apparatus which is equipped with a drying section in which a photosensitive material processed with a processing solution is conveyed by a plurality of rollers and dried by drying air from a drying air blowing device, comprising: a plurality of heating rollers whose surfaces are heated by a heat source; and control means for controlling the drying air blowing device to maintain the surface temperature of each of the plurality of heating rollers at a first predetermined temperature, or in a first temperature range for drying the photosensitive material.

In the first aspect of the present invention, after the photosensitive material is processed with the processing solution and then, for example, squeezed, the photosensitive material is conveyed to the drying section. In the drying section, the photosensitive material first contacts the plurality of heating rollers to promote the evaporation of water from the photosensitive material. After that, the drying air is blown on to the photosensitive material to dry the same.

Here, each of the plurality of heating rollers is maintained at the first predetermined temperature or in the first temperature range by an on-off control of the first control means. However, there is the possibility that a drying fan may not operate during a standby period, and if, at this time, the temperature of each of the plurality of heating rollers is raised, the overshooting becomes vary large, and heat resistance and durability of members in the vicinity of the heating rollers may not be reliably assured. Further, the operating temperature of a safety device for preventing heating must be raised, so that it gets late to cope with an abnormal condition. Further, if the photosensitive material is conveyed in this state, there is a possibility that the temperature of each heating roller may become a temperature of each heating roller may become a temperature close to the overshooting temperature by being dependent upon a timing. Therefore, during the standby period, the drying air from the drying air blowing device is blown on to the surface of each of the heating rollers to restrict the overshooting and lower the surface temperature of each heating roller. Accordingly, overdrying of the photosensitive material can be prevented.

In accordance with a second aspect of the present invention, there is provided, in the first aspect of the present invention, a photosensitive material processing apparatus, in which the first control means controls the drying air blowing device such that the drying air blown from the blowing device lowers the surface temperature of each of the plurality of heating rollers to a temperature lower than the first predetermined temperature or the first temperature range during standby period.

In accordance with a third aspect of the present invention there is proved, in the second aspect of the present invention, a photosensitive material processing apparatus, in which the first control means maintains the surface temperature of each of the plurality of heating rollers by on-off control of the heat source during processing of the photosensitive material, and maintain the surface temperature of each of the plurality of heating rollers in a second temperature range which is lower than the predetermined temperature, during the standby period. In addition, a second control means controls the during air blowing device such that, when the temperature of the heat source is controlled during the standby period, the drying air blowing device may be operated when the surface temperature is higher than the predetermined temperature within the temperature range.

In the second and third aspects of the present invention when the photosensitive material is in a standby state, the surface temperature of each of the plurality of heating rollers is set in the second temperature range which is lower than the predetermined temperature during processing of the photosensitive material. When, during processing, the surface temperature becomes higher than the predetermined temperature in the above-described second temperature range by the overshooting during a temperature-controlling time period, the fan of the drying air blowing device is operated. As a result, the temperature of each heating roller decreases, so that insecurity of heat resistance and durability of members disposed in the vicinity of heating rollers can be alleviated. Further, an abnormal condition can be quickly detected since a set temperature of a safety device for preventing heating results in improved safety. Moreover, it is possible to prevent dry processing of the photosensitive material at the temperature close to overshooting over the predetermined temperature during processing, thereby allowing overdrying of the photosensitive material to be prevented. Further, since the surface temperature is maintained at a low temperature during the standby period, consumed electric power is reduced.

In accordance with a fourth aspect of the present invention, there is provided a photosensitive material processing apparatus which is equipped with a drying section in which a photosensitive material processed with a processing solution is conveyed by a plurality of rollers and dried by drying air from a drying air blowing device. The device includes a plurality of heating rollers whose surfaces are heated by a heat source; a control means which, during processing of the photosensitive material, effects on-off control of the heat source to maintain the surface temperature of each of the plurality of heating rollers at a predetermined temperature, and during a standby period, effects on-off control on the heat source to make the surface temperature lower than the predetermined temperature; and a means for setting a start tie for raising the surface temperature of the heating rollers on the basis of the conveying speed of the photosensitive material.

In the fourth aspect of the present invention, the plurality of heating rollers are each controlled such that their temperature is maintained at a temperature (standby temperature) which is lower than the predetermined temperature during processing. When it is detected that the photosensitive material is inserted into the apparatus, the temperature of each heating roller is raised to the predetermined temperature before the photosensitive material is conveyed to the drying section. Here, the conveying speed of the photosensitive material may vary in accordance with the type of photosensitive material. Further, when the temperature of each heating roller is forcibly raised in a state in which hot air is blown onto the heating roller, a rising speed of the temperature of each heating roller slows down.

For this reason, a start time setting means set a start time for raising the surface temperature of each heating roller based on the temperature of the drying air and the conveying speed of the photosensitive material. As a result, when the photosensitive material reaches the area directly before the drying section, the surface temperature can be maintained at an optimum temperature irrespective of the conveying speed.

In accordance with a fifth aspect of the present invention, there is provided a photosensitive material processing apparatus which is equipped with a drying section in which a photosensitive material processed with a processing solution is dried by heating rollers which contact the surface of the photosensitive material and a drying air supplied by a drying air blowing device. The apparatus include controlling the means for controlling the temperature of the drying air, which exerts on-off control of an air heater and a fan, to maintain the temperature of the drying air at a predetermined temperature; a heater for heating the heating rollers; a temperature setting means which sets the set temperature on the surface of each of the heating rollers on the basis of a processing time for the photosensitive material or a conveying speed thereof; and another controlling means for controlling the temperature of each of the heating rollers by effecting on-off control of the heater to maintain the surface temperature of each of the heating rollers at the temperature determined by the temperature setting means.

In accordance with a sixth aspect of the present invention, there is provided, in the fifth aspect of the present invention, a photosensitive material processing apparatus, further comprising: a correction means which corrects the set temperature determined by the temperature setting means, on the basis of the processing amount of the photosensitive material.

In the fifth and sixth aspects of the present invention, after the photosensitive material is processed with the processing solution and the, for example, squeezed, the photosensitive material is conveyed to the drying section. In the drying section, the photosensitive material first contacts the plurality of heating rollers so that the evaporation of water from the photosensitive material is promoted. After that, drying air is blown onto the photosensitive material to dry the same.

Here, the heating rollers are heated by the respective heaters being turned on. The surface temperature of each heating roller is set on the basis of the processing time and the conveying speed of the photosensitive material. However, since the humidity in the drying section becomes higher together with an increase in the processing amount of the photosensitive material per unit time, the set surface temperature of each heating roller is corrected by the correction means on the basis of the processing amount of the photosensitive material. When the temperature of each heating roller is maintained at the corrected temperature, the photosensitive material can be dried at an optimum temperature without formation of drying marks, irrespective of the processing amount of the photosensitive material.

In accordance with a seventh aspect of the present invention, there is provided, in the fifth aspect of the present invention, a photosensitive material processing apparatus, in which the temperature setting means sets the temperature on the surface of each of the heating rollers by setting the temperature of the drying air to a reference temperature and by adding or subtracting a correction value set on the basis of a processing time of the photosensitive material or a conveying speed thereof, to or from the reference temperature.

In the seventh aspect of the present invention, since there exists a correlation between the drying by the heating rollers and the drying by the drying air, the set temperature of each heating roller is set on the basis of the temperature of the drying air. For example, if a correction value T is added to or subtracted from the temperature $T_o$ of the drying air, then the temperature $T_{HR}$ of each heating roller is obtained ($T_{HR}=T_o+T$).

The correction value T is determined on the basis of the processing amount and the conveying speed of the photosensitive material. The correction value T is set in a range of $-50° \leqq T \leqq 150$ ° C., and preferably, $-15° < T < 35$ ° C.

Thus, since the temperature of each heating roller is set on the basis of the temperature of the drying air, each rate, which the heating rollers and the drying air respectively contribute toward the drying of the photosensitive material, is maintained at a well-balanced state and deterioration in finishing of the photosensitive material, such as formation of drying marks, will not be caused.

In accordance with an eighth aspect of the present invention, there is provided, in the fifth aspect of the present invention, a photosensitive material processing apparatus, in which the temperature setting means correlatively sets a set temperature on the surface of each of the heating rollers and a temperature of the drying air on the basis of a processing time, a processing amount and an environmental condition of the photosensitive material and the temperature controlling means for drying air and for heating rollers effects on-off control on the drying air blowing device and the heater, respectively, to maintain the temperature of the drying air and the surface temperature of each of the heating rollers at the respective temperatures determined by the temperatures setting means.

In the eighth aspect of the present invention, the surface temperature of each heating roller and the temperature of the drying air are not independently determined, and are correlatively determined on the basis of the processing time, the processing amount and the environmental conditions of the photosensitive material. This makes it possible to maintain the temperature of each heating roller and the temperature of the drying air in a well-balanced manner, thereby resulting in improving the drying efficiency of the photosensitive material and maintaining a suitably dried state.

The photosensitive material processing apparatus described in the eighth aspect of the present invention can be constructed such that a water vapour film formed on the surface of the photosensitive material in the vicinity of the heating rollers by the heating action of the heating rollers is removed by the drying air from the drying air blowing device. The water vapour film formed on the surface of the photosensitive material heated by the heating rollers prevents the evaporation of water from the photosensitive material. Therefore, an ambient atmosphere in the vicinity of the heating rollers is removed, to prevent formation of water vapour film and promote the evaporation of water by the heating rollers. As a result, the drying efficiency improves.

DESCRIPTION OF THE PREFERRED EMBODIMENTS

Figure 1:
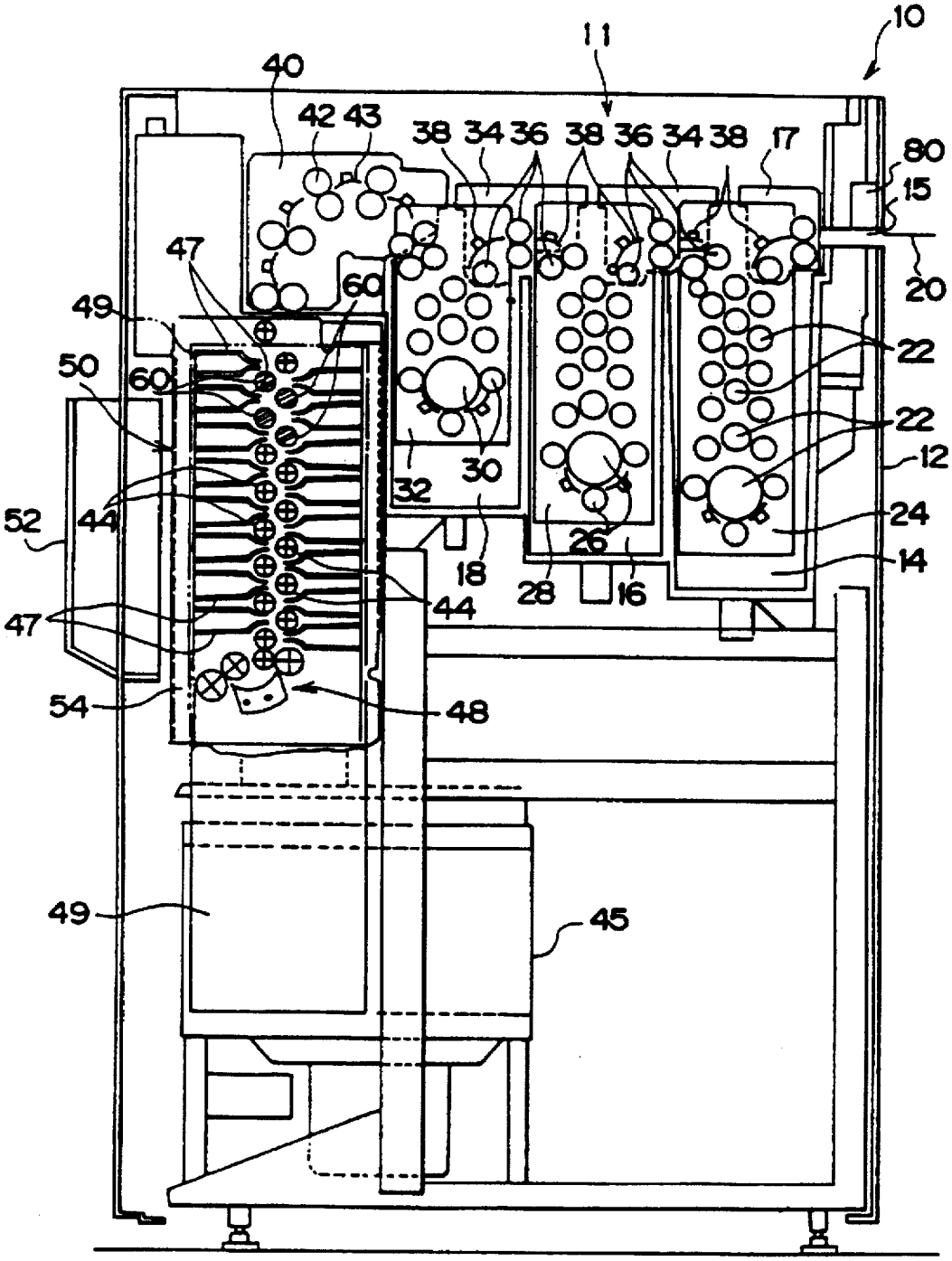
FIG. 1 is a schematic structural view of an automatic developing apparatus according to a first embodiment of the present invention.

Referring to FIG. 1, an automatic developing apparatus 10 serving as a photosensitive material processing apparatus to which the present invention is applied. The automatic developing apparatus 10 is used to process a film 20, which is an example of a photosensitive material, by immersing the fill in developing solution, fixing solution and washing water, and then dry the processed film 20.

The automatic developing apparatus 10 is provided with a solution-processing section 11 and a drying section 50 within a casing 12. The solution-processing section 11 is provided with a developing tank 14 that stores a developing solution, a fixing tank 16 that stores a fixing solution, and a washing tank 18 that stores washing water. In the vicinity of a film inlet 15 for inserting the film 20, which is provided in the casing 12, an inserting rack 17 for inserting the fill 20 inside the casing 12, and a film insertion detecting sensor 80, which detects the inserted fill 20, are respectively disposed. The film insertion detecting sensor 80 is connected to a control section 64 (shown in FIG. 6).

Within the developing tank 14, fixing tank 16 and washing tank 18 of the solution-processing section 11 and conveying racks 24, 28 and 32, respectively having a plurality of conveying rollers 22, 26 and 30, are submerged in the developing solution, fixing solution and washing water, respectively. Further, between the developing tank 14 and the fixing tank 16, and between the fixing tank 16 and the washing tank 18, crossover racks 34, each having conveying rollers 36 and guides 38 disposed in an upper portion of each tank, are respectively provided.

The film 20 inserted at the film inlet 15 is inserted into the automatic developing apparatus 10 by the inserting rack 17, and then is conveyed by the rotational drive of the conveying rollers 22, 26, and 36 while being sequentially immersed in the developing solution, fixing solution and washing water, so that the film can be developed, fixed and washed.

Between the washing tank 18 and the drying section 50, a squeezing rack 40 is disposed. The squeezing rack 40 comprises a plurality of squeezing rollers 42, which squeeze and convey the film 20, and a plurality of guides 43, which guide the film 20 toward the drying section 50. These squeezing rollers 42 convey the film 20, delivered from the washing tank 18, to the drying section 50, while squeezing off water adhering to the surface of the film 20.

A crossover rack having the same structure as that of the crossover rack 34 disposed between the developing tank 14 and the fixing tank 16 and between the fixing tank 16 and the washing tank 18, may be used, in place of the squeezing rack 40, including the squeezing rollers 42 and the guide 43, which are disposed near the washing tank 18.

Figure 2:
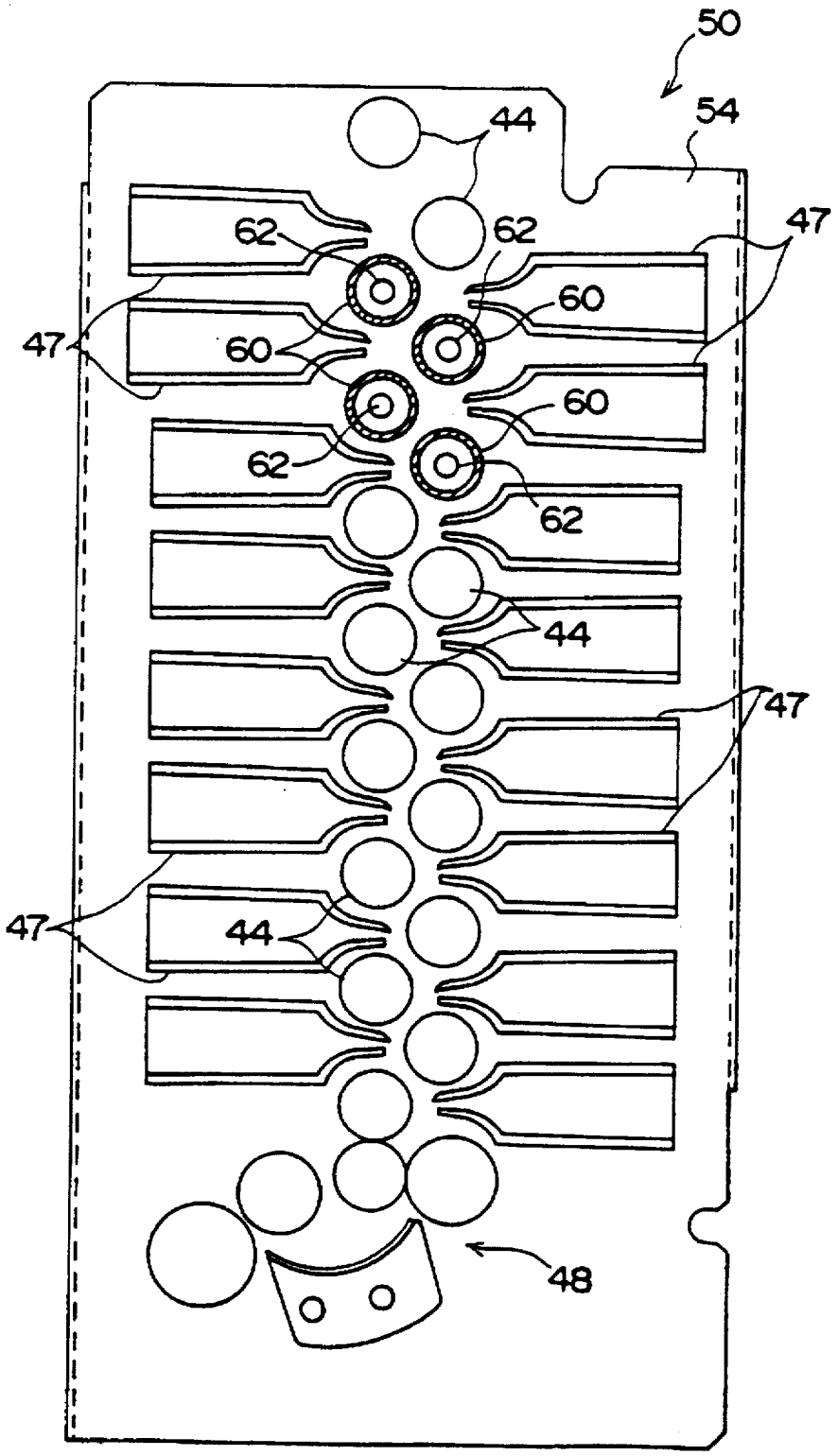
FIG. 2 is a front view illustrating a state in which a plurality of rollers and heating rollers within a drying section are arranged.

As illustrated in FIG. 2, in the drying section 50, conveying rollers 44 and heating rollers 60, suspended between a pair of side plates 54 disposed parallel to each other are arranged in a zigzag manner to form therein a conveying path for conveying the film 20. Further, blowing pipes 47 are also disposed in drying section 50, which blows out drying air, generated by a drying air-supplying section 45 (having a heater 90 and a drying fan 92, both shown in FIG. 4), toward the neighborhoods of the conveying rollers 44 and heating rollers 60. These blowing pipes 47 are proved between the respective conveying rollers 44 and heating rollers and are disposed independently of each other. Referring to FIG. 1, a chamber 49 is provided at an end portion of each blowing pipe 47 in a longitudinal direction thereof.

Drying air generated by the heater and the drying fan is temporarily stored i the chamber 49 and is brought to a pressure-equalized state. Thereafter, the equalized drying air is delivered to each of the blowing pipes 47 and blown from each opening of the blowing pipes 47.

The order of arrangement of the conveying rollers 44 and the heating rollers 60 within the drying section 50 consists of two conveying rollers 44 arranged from the upper portion of the drying section 50, four heating rollers 60 arranged thereunder, and ten conveying rollers 44 arranged further thereunder. The film 20 is conveyed downward by a conveying force applied thereto while obverse and reverse surfaces of the film 20 sequentially contact the conveying rollers 44 and the heating rollers 60, which are arranged in a zigzag manner as described above. At the same time, the film 20 is heated and dried by drying air blown from the blowing pipes 47.

The drying air is blown toward the neighborhoods of the heating rollers 60, and serves to remove the ambient atmosphere near the heating rollers 60. Removal of this ambient atmosphere will prevent formation of a film of water vapour normally generated because the film 20 is heated by the heating rollers 60, making it possible to promote the evaporation of water by means of the heating rollers 60.

Figure 3:
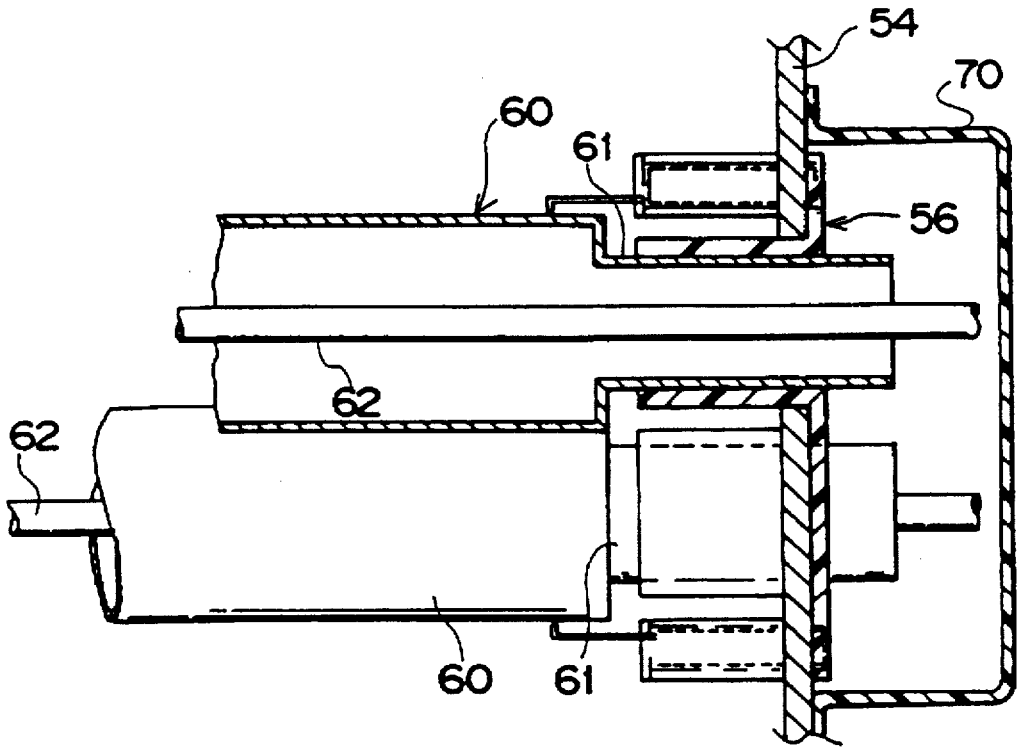
FIG. 3 is a cross-sectional view of a heat roller and its vicinity, viewed from an axial direction of the heat roller.

As illustrated in FIG. 3, the heating roller 60, formed into a hollow structure, is provided with a halogen lamp 62 disposed on an axial line of the heating roller 60. When the halogen lamp 62 is turned on, the surface of the heating roller 60 is heated. The heating roller 60 is constructed such that an axial portion 61 thereof is supported by the side plate 54 via a bearing 56. Further, a cover 70 which prevents the outside air from flowing into the heating roller 60, is mounted to the side plate 54.

Returning to FIG. 1, a drying turn portion 48 is provided in a lower portion of the drying section 50. The film 20 dried by the heating rollers 60 and drying air is turned in an obliquely upward direction in the drying turn portion 48, and thereafter, the film 20 is stocked in a receiving box 52.

Figure 4:
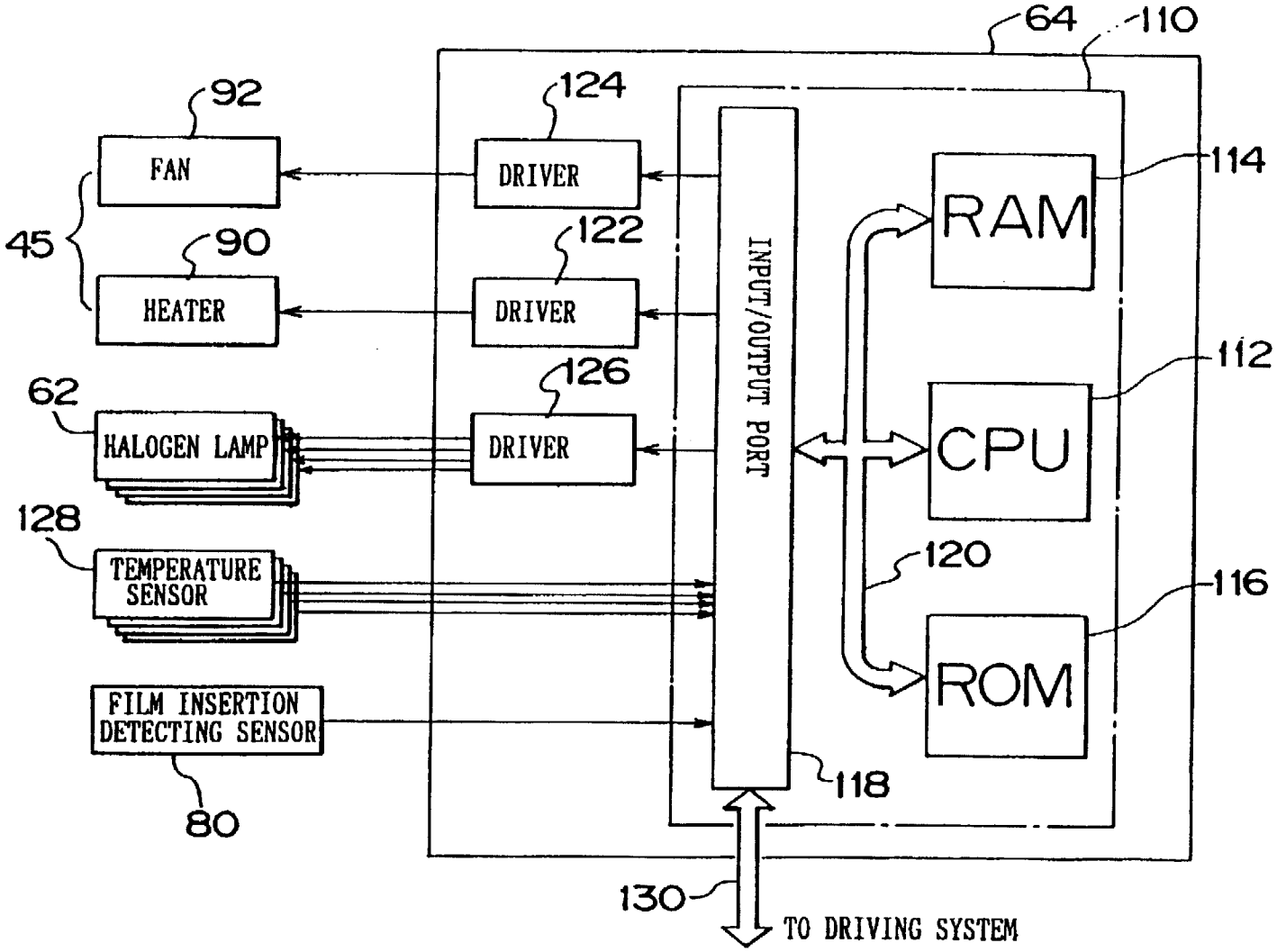
FIG. 4 is a control block diagram according to the first embodiment.

As illustrated in FIG. 4, a control section 64 includes a microcomputer 110 comprising a CPU 112, a RAM 114, a ROM 116, an input/output port 118, and a bus 120, such as a data bus or controller bus, which connects these devices.

The heater 90 and the fan 92 of the above-described drying air-supplying section 45 are connected to the input/output port 118 via drives 122, 124, respectively. Four halogen lamps 62 are respectively connected to the input/output port 118 via driver 126.

Temperature sensors 128, each of which detects the temperature of the circumferential surface of each heating roller 60, where the halogen lamps 62 are accommodated, and the film insertion detecting sensor 80 are respectively connected to the input/output port 118.

In addition, a signal line 130, which controls the driving system for the respective tanks and the drying section 50, is also connected to the input/output port 118.

Next, the operation of the present embodiment will be described.

The film, onto which an image is printed by exposure, is inserted int the automatic developing apparatus 10 by the film inlet 15 thereof for processing. In the automatic developing apparatus 10, the film 20 inserted from the film inlet 15 is loaded by the inserting rack 17 and is conveyed into the developing tank 14 of the solution-processing section 11.

In the developing tank 14, the film 20 is immersed in the developing solution while being conveyed by the conveying rollers 22 of the rack 24 into a substantially U-shaped configuration, and is thereby subjected to development processing. The developed film 20 processed in the developing tank 14 is guided and conveyed by the guides 38 and the conveying rollers 36 of the crossover rack 34 for delivery to the fixing tank 16. In the fixing tank 16, the film is immersed in the fixing solution while being guided and conveyed by the conveying rollers 26 of the rack 28 into a substantially U-shaped configuration, and is thereby subjected to fixation processing. The fixed film 20 processed in the fixing tank 16 is guided and conveyed by the crossover rack 34 for delivery to the washing tank 18. In the washing tank 18, the film 20 is conveyed by the conveying rollers 30 of the rack 32 immersed in the washing water to remove the fixing solution components from the surface of the film 20.

The film 20, for which wash processing has been completed, is guided and conveyed from the washing tank 18 by the squeezing rollers 42 and guides 43 of the squeezing rack 40 and then delivered to the drying section 50 from the solution-processing section 11. At this time, water adhering to the surface of the film 20 is squeezed off by the squeezing rollers 42.

In the drying section 50, the fill 20 is conveyed in such a manner that obverse and reverse surfaces of the film 20 contact two conveying rollers 44 alternately, and at the same time, drying air is blown onto the fill 20. Accordingly, water drops which remain in particular at a leading or trailing end portion of the film in the conveying direction without being completely squeezed off by the above-described squeezing rollers 42, and water drops which remain in a non-uniform state throughout the film 20, can be brought into a relatively uniform state.

Next, the film 20, to which water drops adhere relatively uniformly by the above-described conveying rollers 44 and drying air, is conveyed such that obverse and reverse surfaces of the fill 20 alternately contact four heating rollers 60, resulting in evaporation of the water drops. At this time, there is the possibility that evaporated water may remain on the surface of the fill 20 and a water vapour film may be formed which prevents the subsequent evaporation of water from the film. However, in the first embodiment drying air is blown from the blowing pipe 47, corresponding to the heating rollers 60, toward a portion of the fill 20 near the heating rollers 60, the evaporated water is removed, and formation of a water vapour fill is thereby prevented. Accordingly, the evaporation of water from the film 20 is smoothly effected. At this time, since no water drop mark is formed on the film 20, there is no possibility that the evaporation of water is partially performed, causing the evaporation of water to be promoted uniformly on the entire surface of the film 20.

Subsequently, the drying air generated in the drying air-supplying section 45 is blown out from the blowing pipes 47 toward obverse and reverse surfaces of the film 20 while conveying the film 20 is heated and dried. When the film 20 is heated and conveyed to the drying turn portion 48, the film 20 is turned obliquely upward and is discharged to and stocked in the receiving box 52 (shown in FIG. 1).

Next, the temperature control in the drying section 50 of the first embodiment will be described in accordance with the timing chart shown in FIG. 5. It should be noted that FIG. 5A and 5B shows the timing chart for a 30-second processing sequence, for which the processing temperature is different from that of a 45-second processing sequence.

Figures 5A, 5B:
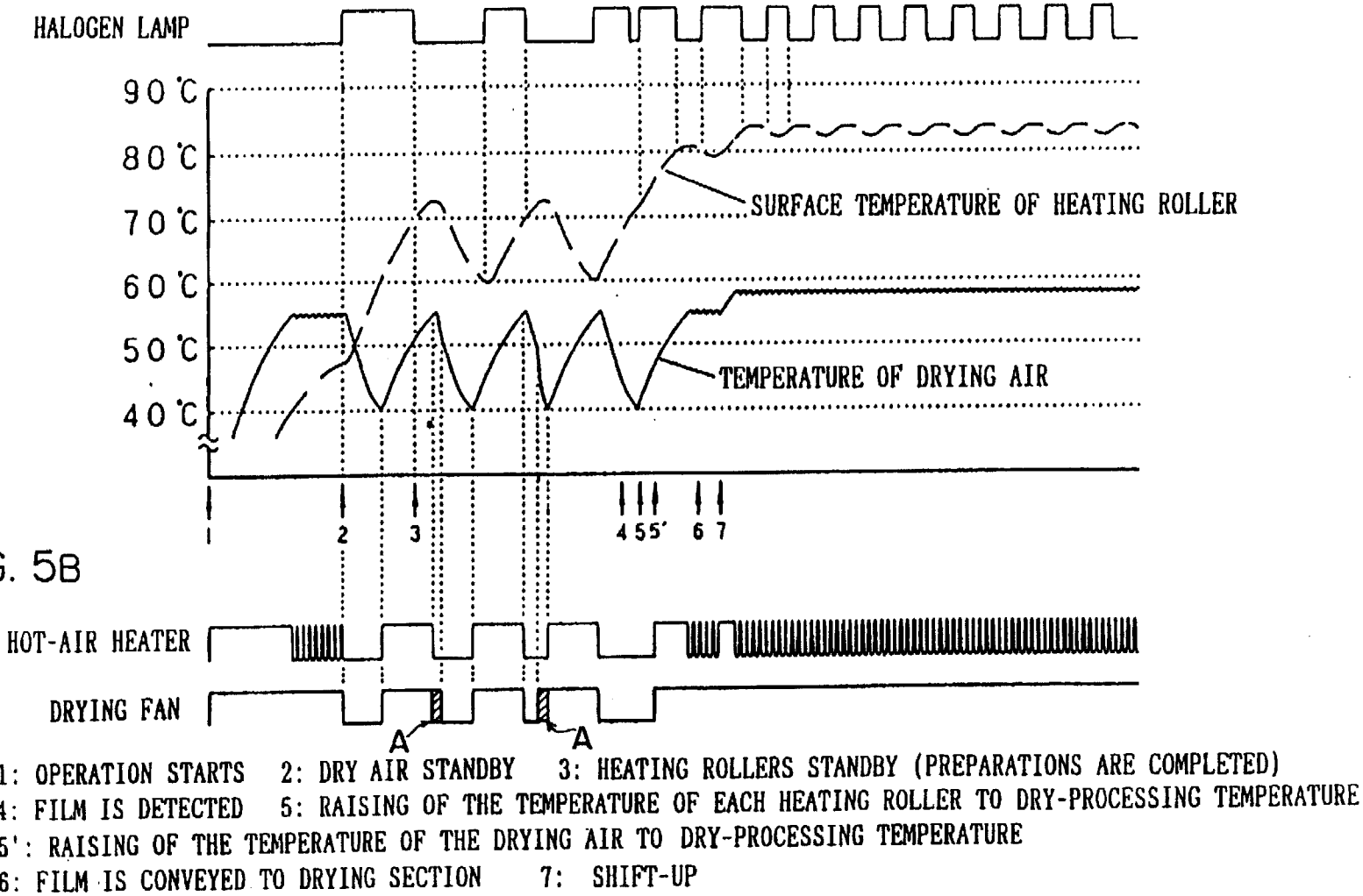
FIG. 5A and 5B are a timing charts according to the first embodiment.

In FIG. 5A, arrow "1" indicates an operation start time. At the time of starting the operation, the hot-air heater 90 and the fan 92 operate, and after a lapse of a predetermined time $t_1$, the hot-air heater 90 is periodically turned on or off to keep a drying air temperature of 55° C. (in the 45-second processing, 54° C.). At this time, the surface temperature of each of the heating rollers 60 is gradually increased due to the drying air to approximately 50 ° C.

After that, at the point in time indicated by arrow "2" in FIG. 5A the halogen lamp 62 is turned on and the surface temperature of each of the heating rollers 60 rapidly increases to 70° C. (in the 45-second processing, 54° C.), which is an upper limit value of the standby temperature as illustrated in arrow "3" in FIG. 5A. At this point in time, the halogen lamp 62 is turned off.

On the other hand, at the point in time indicated by arrow "2" in FIG. 5A, the hot-air heater 90 and the fan 92 are turned off. After this point the hot-air heater 90 is turned on and off repeatedly such that the hot-air heater 90 is turned on at a drying-air temperature of 40° C., and is turned off at a drying-air temperature of 55° C. Conventionally, the fan 92 is named on or off together with the on-off control of the hot-air heater 90. However, in the present embodiment, the fan 92 is always in an on state when the hot-air heater 90 is in an on state, but the fan 92 is adapted to be mined on in other cases as well.

In other words, when the surface temperature of each of the heating rollers 60 overshoots 70° C., which is an upper limit value, by at least +2° C., the fan 92 is turned on even with the hot-air heater 90 in an off state (see an arrow A in FIG. 5B). As a result, the surface temperature of each of the heating rollers 60 can be lowered readily.

After that, the on-off control of each of the heating rollers 60 is repeated such that each surface temperature thereof is set in a range of temperature between 60° C. (in the 45-second processing, 50° C., representing a lower limit value for the standby temperature) and 70° C. (in the 45-second processing, 54° C.).

When film 20 is detected by the fill insertion detecting sensor 80 (at the point in time indicated by an arrow "4" in FIG. 5A), the surface temperature of each of the heating rollers 60 begins to increase to a processing temperature (indicated by an arrow "5" in FIG. 5), and subsequently, the temperature of the drying air begins to increase to a processing temperature (indicated by an arrow "5'" in FIG. 5A).

It should be noted that the predetermined time period from when the film 20 is detected by the film insertion detecting sensor 80, between arrows "4" and "5" in FIG. 5A, varies in accordance with the conveying speed (linear speed) of the film 20. Namely, in the apparatus of the present invention, the processing time from when the film 20 is inserted to when dry processing is completed is set to be 35 second or 45 seconds, and the conveying speed of the fill 20 is set to 72.5 mm/sec in the case of 30-second processing, while in the case of 45-second processing, the conveying speed is set to 46.3 mm/sec. Due to the difference in processing speeds, each processing, from when the film 20 is detected by the fill insertion detecting sensor 80 to when a leading end of the film 20 reaches the drying section is different from a previous processing. Accordingly, each start time, for raising the surface temperature of each heating roller and the drying-air temperature, is varied for each processing time (i.e., the points in time indicated by arrows "5" and "5'" in FIG. 3A are respectively shifted), so that each ending time for raising each respective temperature (see arrow "6" in FIG. 5A) is set at a fixed position at any time.

In the present embodiment, for 30-second processing, the time when fixation of the film 20 starts is set to a start time for raising the surface temperature of each heating roller, and the time when wash processing of the fill 20 starts is set to a start time for raising the surface temperature of each heating roller, and the time when was processing of the film 20 is completed is set to a start time for raising of the temperature of the drying air.

After this period (after the point of time indicated by arrow "6" in FIG. 5A), a short-period on-off control for the hot-air heater 90 is repeated to maintain the temperature of the drying air at approximately 55° C.

On the other hand, after the film is conveyed to the drying section, if the surface temperature of each of the heating rollers 60 is lower than a preset temperature (for example, in the 30-second processing, 80° C., and in the 45-second processing, 54° C.) by at least 1° C., the halogen lamp 62 remains continuously in an on state, while when it becomes higher than the set temperature by at least 2° C., the halogen lamp 62 remains continuously in an off state. When the surface temperature of each of the heating rollers 60 is between 2° C. greater than the preset temperature and 1 ° C. less than the preset temperature, the halogen lamp 62 is controlled to be repeatedly turned on for 1.5 seconds and turned off for 1 second, so that the temperature of each of the heating rollers 60 is maintained at approximately 80° C. (in the 45-second processing, 54 ° C.).

Further, when there are a large number of films to be processed, the set temperature is set to be slightly higher (for example 83° C. for 30-second processing and 57° C. for 45-second processing). In this case, at the point in time indicated by arrow "7" in FIG. 5A, the above-described stationary temperature control is temporarily stopped, and after the halogen lamp 62 and the hot-air heater 90 are continuously turned on to increase the temperature of each heating roller, the stationary temperature control may be started again.

Thus, in the present embodiment, the temperature of each heating roller during the standby period is set to be slightly lower than that during dry processing, thereby allowing reduction in consumption of electric power. Further, in the conventional manner the temperature control is effected roughly, without varying the set temperature in the standby period. As a result, there is the possibility that the film might be overdried in an early stage of the drying time period. However, in the present embodiment, this overdrying can be prevented by causing the set temperature during the standby period to be lowered.

In addition, not only the surface temperature of each of the heating rollers 60 is controlled by an on-off control during the standby period of the halogen lamp 62, but also the heating rollers 60 may be driven independently of the hot-air heater 90 of the fan 92 when the surface temperature of each heating roller becomes higher than the set upper limit value during the standby period (70° C. for 30-second processing and 54° C. for 45-second processing) by +2° C., so that the surface temperature thereof can be speedily lowered. Accordingly, heat resistance and durability for other members in the vicinity of the heating rollers 60 is ensured. Further, for example, the operating temperature for a safety device (such as a temperature fuse) which cuts off the power source when the surface temperature is equal to or greater than a predetermined value, can be lowered.

Further, the start time for raising the temperature of the heating rollers (the point in time indicated by an arrow "5" in FIG. 5A) from the standby period temperature to the processing temperature may be varied in accordance with the conveying speed of the film 20. Accordingly, even if the conveying speed varies, each heating roller can be controlled such that its temperature becomes optimal right before when the film 20 reaches the drying section 50, to prevent over-drying and underdrying.

Next, a second embodiment of the present invention will be described.

Since the mechanism for the second embodiment is the same as that of the first embodiment, when needed, it will be explained by use of FIGS. 1 through 3 of the first embodiment and the reference numerals illustrated therein, with a different mechanism explained by reference to FIG. 6.

Figure 6:
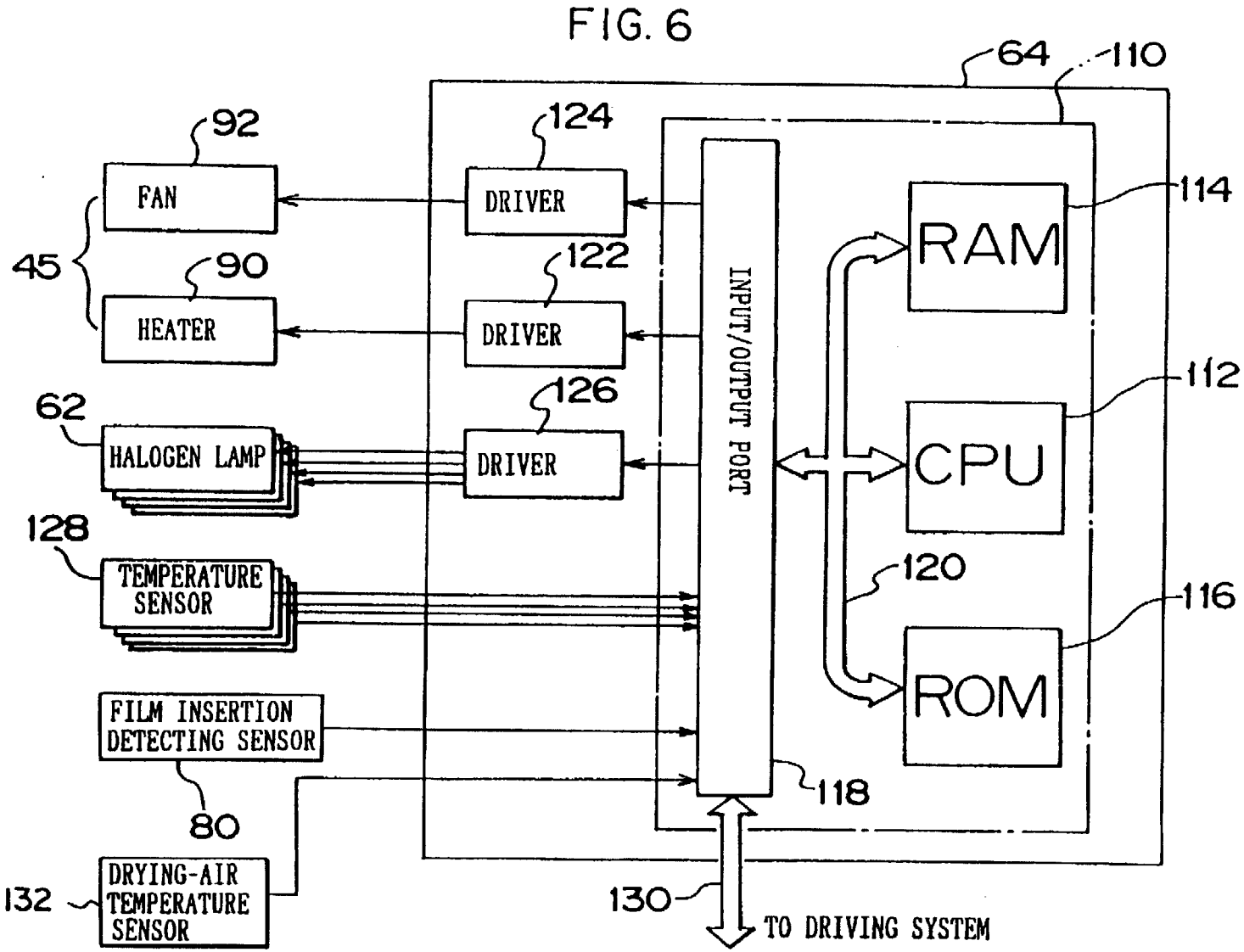
FIG. 6 is a control block diagram according to a second embodiment of the present invention.

As illustrated in FIG. 6, in this embodiment temperature sensors 128, each for detecting the temperature of the peripheral surface of a heating roller 60 accommodating a halogen lamp 62, a drying-air temperature sensor 132 for detecting the temperature of the drying air, and a film insertion detecting sensor 80, are respectively connected to the input/output port 118.

On the basis of the signals of the temperature sensors 128 and the drying-air temperature sensor 132, the surface temperature of each of the heating rollers 60 and the temperature of the drying air are maintained at set values. The set value for the drying air temperature $T_o$ is 55° C. for standard 30-second processing (at a speed of approximately 1000 to 3000 $cm^2$/min), with the set value for the surface temperature of each of the heating rollers 60, $T_{HR}$ being obtained on the basis of the drying-air temperature To. The relationship between the surface temperature $T_{HR}$ for each of the heating rollers 60 and the drying-air temperature $T_o$ is expressed as $T_{HR}=T_o+T$, where T is a correction value which varies in accordance with the processing time and processing amount. For the above-described standard processing, T is set to +15 ° C. As a result, the surface temperature $T_{HR}$ for each of the heating rollers 60.

In addition, in the same fashion as in the first embodiment, the signal line 130, for controlling the driving system for each tank and for the drying section 50, is connected to the input/output. port 118.

Other structures are the same as those of the first embodiment, and a description thereof will be omitted.

The operation of the second embodiment will be described hereinafter. It should be noted that only the operation thereof which is different from that of the first embodiment will be described.

In the second embodiment, since the surface temperature of each of the heating rollers 60 is influenced by the drying air, it is determined on the basis of the temperature of the drying air. Namely, in this embodiment, the drying air temperature $T_o$ is set to 55° C., and the surface temperature $T_{HR}$ of each of the heating rollers 60 is set to 80° C. This temperature $T_{HR}$ is the value ($T_{HR}=T_o+T$) obtained by adding the value T (=25° C.), which is set on the basis of the processing time and the conveying speed, to the drying-air temperature $T_o$ (=55° C.). Accordingly, when the drying-air temperature $T_o$ is 58° C., the surface temperature (target value) of each of the heating rollers 60 is automatically set to 83° C.

Thus, since there is a correlation between the drying-air temperature and the surface temperature for each of the heating rollers 60, the film can be dried in a well-balanced state, preventing formation of drying marks.

Here, in the second embodiment, if there are a large number of films to be processed, the surface temperature of each of the heating rollers 60 is increased by ° C. However, as illustrated in Table 1 below, an adjustment amount corresponding to a processing amount is respectively set for a variety of different processing amounts.

TABLE 1

| 30-second processing | | 45-second processing | |
|---|---|---|---|
| processing amount | adjustment temperature | processing amount | adjustment temperature |
| 0~1000 $cm^2$/min | −4° C. | 0~1000 $cm^2$/min | −6°C. |
| 1000~3000 $cm^2$/min | ±0° C. | 1000~3000 $cm^2$/min | ±0° C. |
| 3000~7000 $cm^2$/min | +2° C. | 3000~5000 $cm^2$/min | +1° C. |
| 7000 $cm^2$/min ~ | +3° C. | 5000~8000 $cm^2$/min | +2° C. |
| | | 8000 $cm^2$/min ~ | +3° C. |

As illustrated in Table 1, when the surface temperature of each of the heating rollers 60 is varied in accordance with the processing time and the processing amount, even if the processing amount increases to cause the humidity within the drying section 50 to increase, the film can be dried uniformly at any time.

Meanwhile, in this embodiment, in order to determine the drying-air temperature and the surface temperature of each of the heating rollers 60, the drying-air temperature is first determined in accordance with the processing time, the processing amount and the like, and on the basis of the set temperature of the drying air, the surface temperature of each of the heating rollers 60 can be determined. However, a table used to store previously set respective temperature on the basis of the processing time, the processing amount, and the environmental conditions (environmental absolute humidity) (see Table 2, and the respective suitable temperatures may be read out from the table.

TABLE 2

| environmental absolute humidity Z | 30-second processing processing amount S per unit time ($m^2$/min) | | | |
|---|---|---|---|---|
| (g/kg) | S ≦ 0.1 | 0.1 S ≦ 0.4 | 0.4 S ≦ 0.9 | 0.9 S |
| Z 5 | 72 | 76 | 78 | 79 |
| | 50 | 61 | 63 | 64 |
| 5 ≦ Z 10 | 74 | 78 | 80 | 81 |
| | 52 | 63 | 65 | 66 |
| 10 ≦ z 15 | 76 | 80 | 82 | 83 |
| | 54 | 65 | 67 | 68 |
| 15 ≦ Z 20 | 78 | 82 | 84 | 85 |
| | 56 | 67 | 69 | 70 |
| 20 ≦ Z | 80 | 84 | 86 | 87 |
| | 58 | 69 | 71 | 72 |

| environmental absolute humidity Z | 30-second processing processing amount S per unit time ($m^2$/min) | | | |
|---|---|---|---|---|
| (g/kg) | S ≦ 0.1 | 0.1 S ≦ 0.4 | 0.4 S ≦ 0.9 | 0.9 S |
| Z 5 | 44 | 50 | 52 | 53 |
| | 49 | 60 | 62 | 63 |
| 5 ≦ Z 10 | 46 | 52 | 54 | 55 |
| | 51 | 62 | 64 | 55 |

TABLE 2-continued

| | | | | |
|---|---|---|---|---|
| 10 ≦ Z 15 | 48 | 54 | 56 | 57 |
| | 53 | 64 | 66 | 67 |
| 15 ≦ Z 20 | 50 | 56 | 58 | 59 |
| | 55 | 66 | 68 | 69 |
| 20 ≦ Z | 52 | 58 | 60 | 61 |
| | 57 | 68 | 70 | 71 |

upper row: Surface temperature of heating roller (°C.)
lower row: The temperature of dry air (°C.)

Further, in Table 2, the surface temperature of each of the heating rollers 60 and the drying-air temperature are respectively set on the basis of two types of parameters: the environmental absolute humidity and the processing amount. However, each temperature may be set on the basis of the environmental absolute humidity alone.

In accordance with this embodiment, an evaporative film formed on the surface of the film 20 heated by the heating rollers 60 can be removed by blowing out the drying air toward an ambient atmosphere around the heating rollers 60, and the evaporation of water from the film 20 can be promoted. Accordingly, since the drying efficiency by means of the heating rollers 60 can be improved, it is possible to contribute for shortening of the drying time and reduction in heat capacity.

Further, by paying attention to the correlation between the surface temperature of each of the heating rollers 60 and the drying-air temperature and by considering that the respective temperatures interact each other, a well-balanced dry processing of the film can be performed, and formation of drying marks can be prevented. In this embodiment, the heating rollers may be arranged in a zigzag manner as was described earlier. However, the heating rollers may also be disposed in a face-to-face relation with each other.

As described above, the photosensitive material processing apparatus according to the present invention offers an excellent effect in that, when the temperature of each of the heating rollers is controlled, it makes it possible to restrict the overshooting of the temperature of each heating roller. In a standby period, the temperature of each heating roller can be set to be lower than a predetermined value to reduce consumed electric power, so that the temperature can be raised to the predetermined temperature at a suitable timing.

Further, the photosensitive material processing apparatus according to the present invention offers an excellent effect in that it makes it possible to consider a correlation between drying by the heating rollers and drying by the drying air to set the respective temperatures of the heating roller and the drying air, and to vary each set temperature on the basis of various factors, which have influence on drying efficiency, such as the amount of photosensitive material to be processed and an environmental condition thereof, to perform a suitable drying of the photosensitive film without formation of drying marks.

What is claimed is:

1. A photosensitive material processing apparatus equipped with a drying section to which a processed photosensitive material is conveyed by a plurality of rollers and dried by a drying air supplied from a drying air blowing device, comprising:

a plurality of heating rollers whose surfaces are heated by a heat source;

a control means for controlling said heat source of said heating rollers and said drying air blowing device, wherein said control means maintains the surface temperature of each of said plurality of heating rollers in a first predetermined temperature range, and wherein said control means maintains the temperature of said drying air in a second predetermined temperature range.

2. A photosensitive material processing apparatus according to claim 1, wherein the surface temperature of said plurality of heating rollers and the temperature of said drying air are respectively maintained within said first and second predetermined temperature ranges during a standby period representing a warm-up period preceding introduction of said photosensitive material to said drying section.

3. A photosensitive material processing apparatus according to claim 2, wherein said drying air blowing device further comprises a fan and a heating unit capable of independent operation, wherein said control means operates both said fan and said heating unit while the temperature of said drying air is being raised in said second predetermined temperature range, wherein said control means operates said fan independently of said heating unit when a preset temperature of said second predetermined temperature range has been achieved and the surface temperature of said heating rollers have surpassed a predetermined temperature.

4. A photosensitive material processing apparatus according to claim 1, further comprising:

a start time setting means for setting a start time at which the surface temperature of each of said plurality of heating rollers is raised to a temperature higher than the temperatures within said first predetermined temperature range.

5. A photosensitive material processing apparatus according to claim 1, wherein said heat source is disposed within each of said plurality of heating rollers.

6. A photosensitive material processing apparatus equipped with a drying section to which a processed photosensitive material is conveyed by a plurality of rollers and dried by a drying air supplied from a drying air blowing device, comprising:

a plurality of heating rollers whose surfaces are heated by a heat source;

a control means controlling said heat source to set the surface temperatures of said heating rollers below a predetermined temperature during a standby period, said control means controlling said heat source to maintain the surface temperatures of said heating rollers at said predetermined temperature at a start time following said standby period during processing of said photosensitive material; and a start time setting means for setting said start time wherein the surface temperatures of said heating rollers are raised to said predetermined temperature, wherein said start time is set based upon the speed at which said photosensitive material is being conveyed to said drying section.

7. A photosensitive material processing apparatus according to claim 6, wherein said start time setting means raises the temperature of said drying air blown from said drying air blowing device after said start time.

8. A photosensitive material processing apparatus according to claim 6, wherein said drying air blowing device comprises a heater unit which heats air and a fan which blows out air.

9. A photosensitive material processing apparatus according to claim 8, wherein said control means operates said fan in lieu of said heater unit during said standby period when the surface temperature of said heating rollers exceed a preset temperature range.

10. A photosensitive material processing apparatus according to claim 6, wherein said heat source is disposed within each of said plurality of heating rollers.

11. A photosensitive material processing apparatus equipped with a drying section in which a processed photosensitive material processed with a processing solution is dried by heating rollers contacting the surface of said photosensitive material and by a drying air supplied by a drying air blowing device having a heater unit and a fan, said drying section comprising:

a drying air controlling means for controlling a temperature of said drying air by effecting on-off control of said drying air blowing device to maintain the temperature of said drying air at a predetermined temperature;

a heating roller heater for heating said heating rollers;

a heating roller temperature setting means for setting the surface temperature of each of said heating rollers to a set temperature on the basis of a processing time for said processing of the photosensitive material or a conveying speed at which said photosensitive material is conveyed to said drying section; and a heating roller temperature controlling means for controlling a temperature of each of said heating rollers by effecting on-off control of said heating roller heater to maintain the surface temperature of each of said heating rollers at the temperature determined by said heating roller temperature setting means.

12. A photosensitive material processing apparatus according to claim 11, further comprising:

a correction means for correcting the surface temperature for each of said heating rollers on the basis of the amount of processed photosensitive material.

13. A photosensitive material processing apparatus according to claim 11, wherein said drying air supplied by said drying air blowing device removes a water vapor film formed on the surface of the photosensitive material in the vicinity of said heating rollers.

14. A photosensitive material processing apparatus according to claim 13, further comprising:

a drying air operation controlling means for operating said drying air blowing device for a predetermined time period after the surface temperature of each of said heating rollers is raised to said set temperature.

15. A photosensitive material processing apparatus according to claim 11, wherein said heating roller temperature setting means sets the surface temperature of each of said heating rollers by adding a correction value set on the basis of said processing time or said conveying speed to said predetermined drying air temperature.

16. A photosensitive material processing apparatus according to claim 15, wherein said drying air supplied by said drying air blowing device removes a water vapor film formed on the surface of the photosensitive material in the vicinity of said heating rollers.

17. A photosensitive material processing apparatus according to claim 16, further comprising:

a drying air operation controlling means for operating said drying air blowing device for a predetermined time period after the surface temperature of each of said heating rollers is raised to said set temperature.

18. A photosensitive material processing apparatus according to claim 11, wherein said heating roller temperature setting means can correlatively determine said set temperature based upon said processing time, an amount of photosensitive material to be processed, and a condition of the environment of said photosensitive material.

19. A photosensitive material processing apparatus according to claim 1, wherein the surface temperature of said plurality of heating rollers are maintained within said first predetermined temperature range during a heating roller standby period, and wherein the temperature of said drying air is maintained within said second predetermined temperature range during a drying air standby period, wherein said heating roller standby period and said drying air standby period represent warm-up periods before introduction of said photosensitive material to said drying section.

20. A photosensitive material processing apparatus according to claim 1, wherein said start time setting means sets said start time based upon the speed at which said photosensitive material is being conveyed to said apparatus.

21. A photosensitive material processing apparatus according to claim 1, wherein said start time setting means sets said start time based upon the amount of said photosensitive material that is to be conveyed to said apparatus.

* * * * *